US007378760B2

(12) United States Patent
Olmsted

(10) Patent No.: US 7,378,760 B2
(45) Date of Patent: May 27, 2008

(54) BARRIER MOVEMENT OPERATOR WITH CONTROLLED POWER OUTLET

(75) Inventor: Robert J. Olmsted, Wood Dale, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 390 days.

(21) Appl. No.: 10/843,918

(22) Filed: May 12, 2004

(65) Prior Publication Data

US 2005/0254194 A1 Nov. 17, 2005

(51) Int. Cl.
*H01H 19/14* (2006.01)

(52) U.S. Cl. ..... 307/115

(58) Field of Classification Search ..... 307/115
See application file for complete search history.

(56) References Cited

U.S. PATENT DOCUMENTS 4,074,269 A * 2/1978 Hartley ..... 340/825.37
4,475,069 A 10/1984 Tadokoro et al.
4,549,092 A 10/1985 Matsuoka et al.
5,282,337 A 2/1994 Duhame et al.
5,793,300 A 8/1998 Suman et al.
5,936,842 A 8/1999 Kaiser et al.
2005/0126717 A1* 6/2005 Mullet et al. ..... 160/133

FOREIGN PATENT DOCUMENTS

WO WO 00/70203 10/2000
WO WO 03/104907 A1 12/2003

* cited by examiner

*Primary Examiner*—Robert L. DeBeradinis
(74) *Attorney, Agent, or Firm*—Fitch, Even, Tabin & Flannery

(57) ABSTRACT

A barrier movement operator having an integrated mains voltage connection with a selective connection of power to an accessory such as a light is disclosed.

11 Claims, 4 Drawing Sheets

BARRIER MOVEMENT OPERATOR WITH CONTROLLED POWER OUTLET

The present invention relates to barrier movement operators and particularly to accessories for such operators.

Barrier movement operators generally include a control system and a motor for moving a barrier at the request, either express or implied, of a person or occurrence. Garage door openers, gate operators, door operators, window shutters and shade controllers and the like are examples of barrier movement operators, but the present invention is not limited to those specific examples. Barrier movement operators frequently include a removable connection to A.C. mains voltage such as the U.S. standard 110V 60 HZ household voltage. The removable connection may be a standard NEMA 15 amp two pole, three wire plug which is compatible with 110V AC receptacles in homes and industry.

Some ancillary equipment has been known to be connected to barrier movement operators so that a synergistic result can be achieved. For example, due to the shape and size of a garage it may be desirable to add additional light in a garage to be turned on under the control of the barrier movement operator. Such an arrangement is discussed in U.S. Patent application, Publication No. 2003/021 4806. A need exists for a simplified arrangement to provide operating power to a barrier and to control the application of such power to accessory equipment.

DESCRIPTION

Figure 1:
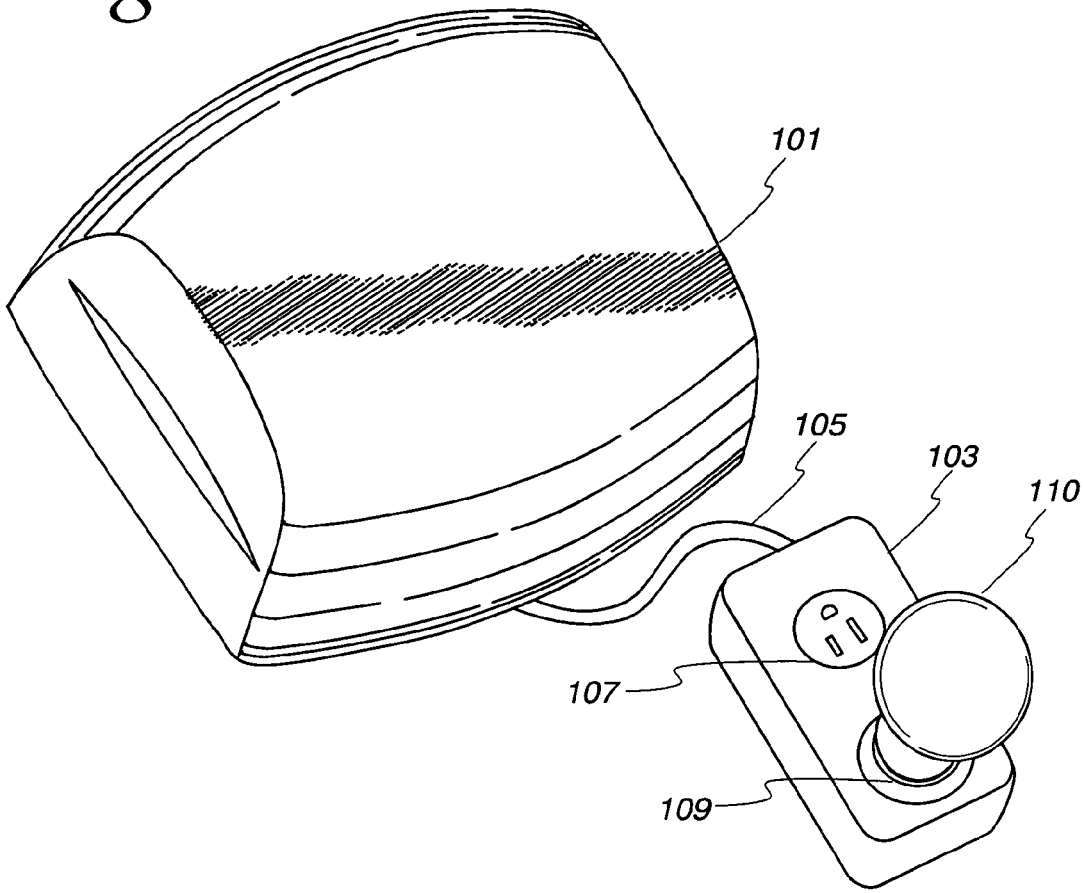
FIG. 1 illustrates a barrier movement system with attached accessories.
Figure 2:
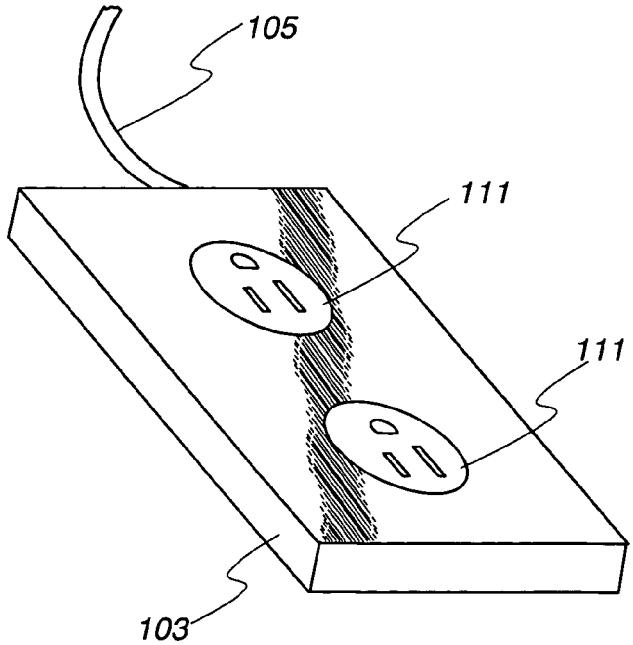
FIG. 2 illustrates a removable connection for an accessory.

FIG. 1 is a perspective view of a combined barrier movement operator and accessory powering system. A barrier movement operator 101 receives operating mains power from an accessory-connect unit 103 via a power conductor 105. Accessory-connect unit 103 includes a standard NEMA 15*a*. outlet 107 and a light bulb socket 109 having a light bulb 110 inserted therein. FIG. 2 shows the reverse face of the accessory-connect unit 103 which includes two NEMA two pole, three conductor plugs 111 which are properly positioned for insertion into both receptacles of a NEMA dual receptacle, two pole, three conductor AC mains outlet (not shown). It should be mentioned that implementation may include a single NEMA plug or may include one or more plugs of a type for connection to local AC mains voltage. A primary purpose for the accessory-connect unit 103 is to be removably connectable to a supply of mains voltage and to connect that voltage to a barrier movement operator 101 and to provide the facility to connect mains voltage to a mains voltage outlet 107 and/or an accessory socket 109.

Figure 3:
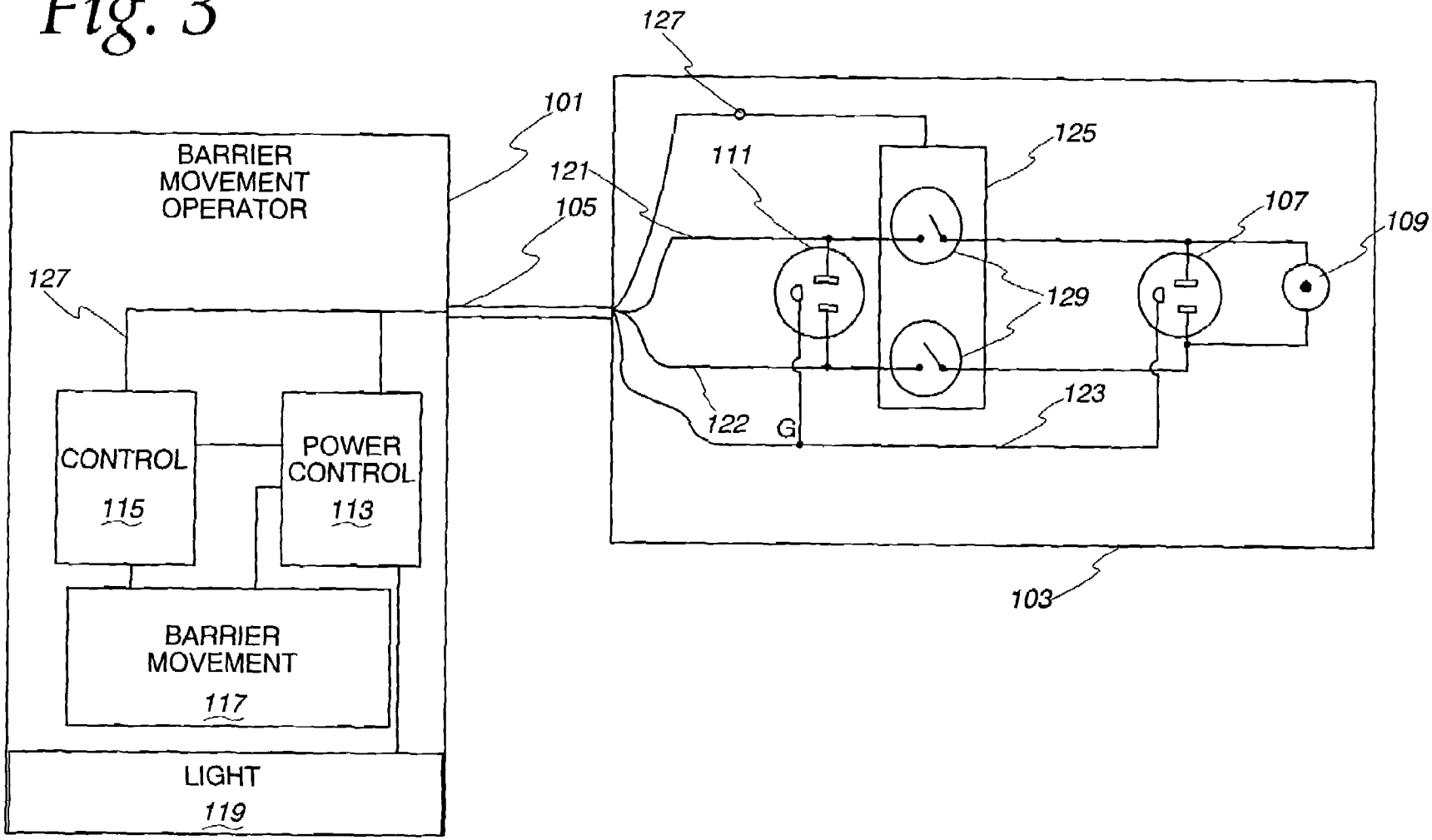
FIG. 3 is an electrical block diagram illustrating the combined barrier movement operator and accessory.

FIG. 3 is a block diagram of an embodiment of the system of FIG. 1. Barrier movement operator 101 comprises power control apparatus 113, a controller 115, barrier movement apparatus 117 and a light assembly 119. Barrier movement apparatus may include a motor and sensors (not shown) which cooperate with control unit 115 to open and close a barrier. Power control unit 113 is equipped to receive mains voltage and to distribute mains voltage, or another created voltage, under the control of controller 115. The light 119 is a common part of barrier movement operators and is used to provide one source of illumination under the control of controller 115.

Plug 111 is removably connectable to a source of mains voltage and connects that voltage to conductors 121,122,123 which represent the hot, neutral and ground conductors respectively of a two pole, three conductor mains voltage source. Conductors 121-123 are connected via power conductor 105 to power control 113 and to a power selector 125 of accessory-connect unit 103. Power control 113 distributes power within barrier movement operator 101 as is needed to provide barrier movement. Controller 115 is also responsible for controlling the application of mains voltage to the outlet 107 and/or light socket 109. To this end, controller controls the voltage applied to a control conductor 127 which provides a hard wired signaling path to power selector 125 via power conductor 105. Power selector 125 may be for example, a low voltage, double pole, single throw relay which is connected to provide mains voltage to outlet 107 and light socket 109 when the poles 129 of the relay are closed. Accordingly, when ever controller 115 determines that additional light should be turned on or that another accessory connected to plug 107 should be powered up, a low voltage signal is sent via conductor 127 to selector 125 which closes its poles and provides the desired power. In other embodiments, power selector 125 may include one or more semiconductor devices which respond to signals on conductor 127 by connecting or disconnecting mains voltage with outlet 107 and/or socket 109.

Figure 4:
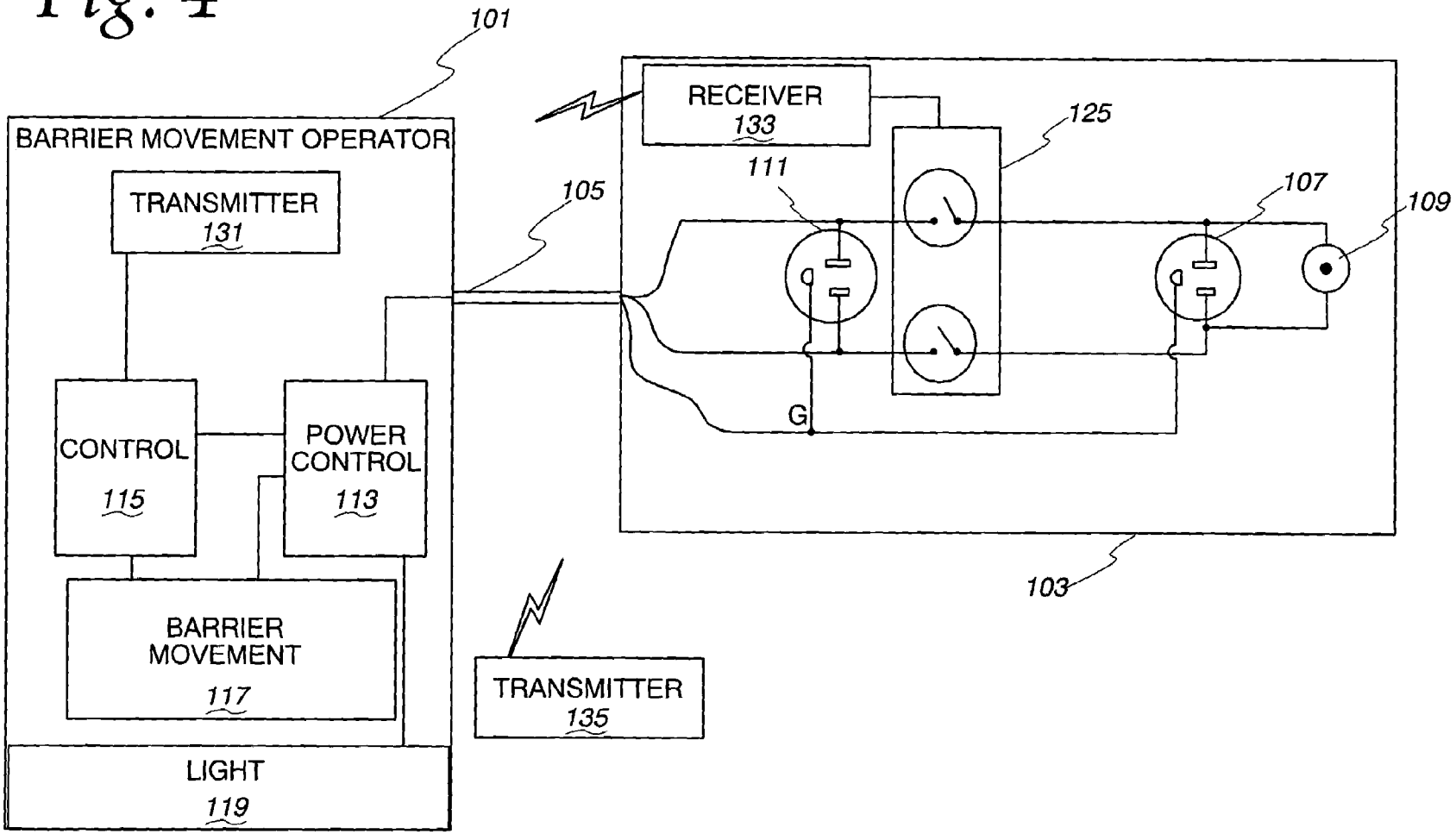
FIG. 4 is an electrical block diagram showing the embodiment of FIG. 1 with a wireless control path.

In FIG. 3 the control channel between controller 115 and power selector 125 is hard wired. The control channel could be implemented as a wireless communication channel such as rf or optical (including infrared) signaling. FIG. 4 represents the embodiment of FIG. 1 using wireless signaling. In FIG. 4 barrier movement operator comprises a wireless transmitter 131 which receives control signals from controller 115 and transmits control signals in response. Accessory-connect unit 103 includes a wireless receiver 133 which receives and validates transmissions from transmitter 131.

Upon receipt and validation of an appropriate transmission, receiver 133 controls power selector 125 to connect or disconnect power. The validation employed is one which provides a level of security desired by the designers and/or users of the system. For example, a single identity code may be employed to assure that only signals from a transmitter having the same identity are responded to by receiver 133. When greater security of transmission is wanted the wireless communication channel might employ a rolling code as is known in the art. When wireless communication is employed, the user may be provided a transportable transmitter 135 to allow the user to have direct control of the power selector 125.

Figure 5:
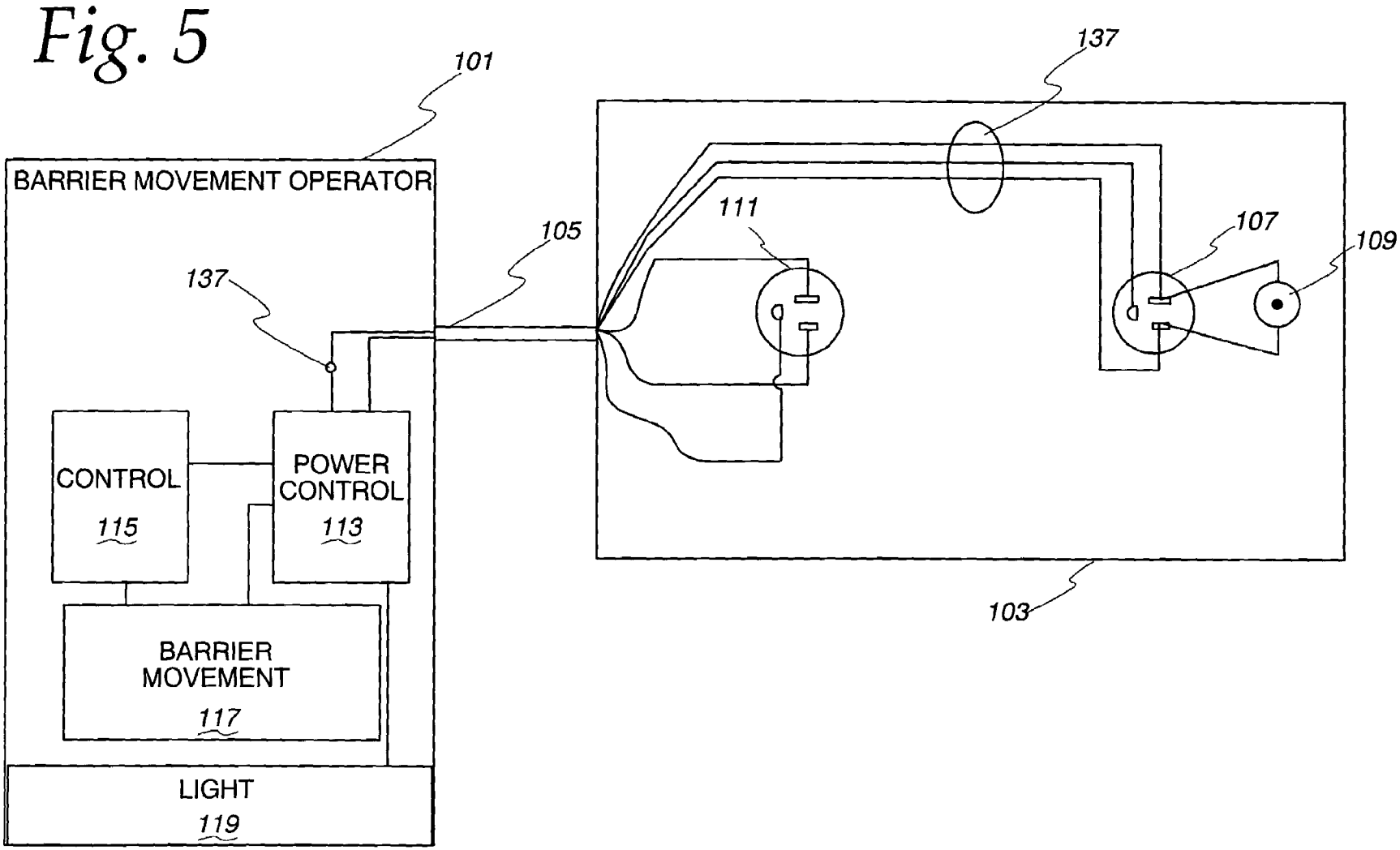
FIG. 5 is an electrical block diagram illustrating another embodiment of the combined barrier movement operator and accessory.

In FIGS. 3 and 4 the connection of mains power to outlet 107 and/or socket 109 was provided by a power selector 125. FIG. 5 is a block diagram of a system in which mains power for the accessories 107 and 109 is selected at power control 113. As with the earlier example, mains voltage is received at plug 111 and connected to barrier movement operator 101 via power conductor 105. Power control 113 operates under the control of controller 115 to selectively connect mains voltage to a conduction path 137 which is conveyed to accessory-connect unit 103 via power conductor 105. The individual hot, neutral and ground conductors of conduction path 137 are connected to plug 107 and/or socket 109 at accessory-connect unit 103. When accessory voltage is to be applied at accessory-connect unit 103, controller 115 directs power control 113 to connect power to conduction path 137 which applies necessary power without intermediate switching. In FIG. 5, the return of power to accessory control 103 is performed using all three conductors of a grounded system. In some embodiments, the ground and neutral mains conductors may remain attached to the appropriate conductors of socket 109 and plug 107 within accessory-connect unit 103. In such a case, selective connection of voltage only on the hot conductor is provided by power control 113. Thus, only the voltage on the hot conductor would be selectively applied to plug 107 and socket 109 via the power connection path 137.

While there has been illustrated and described particular embodiments of the present invention, it will be appreciated that numerous changes and modifications will occur to those skilled in the art, and it is intended in the appended claims to cover all those changes and modifications which fall within the true scope of the present invention.

The invention claimed is:

1. A power connection apparatus for a barrier movement operator, comprising:

a connector for removable connection to a source of mains power;

a first conductive path from the connector to the barrier movement operator;

a power outlet for a barrier movement operator accessory;

a light assembly of the barrier movement operator:

a control apparatus, disposed within a housing of the barrier movement operator, and responsive to control signals from the barrier movement operator for selectively connecting power to the power outlet via a second conductive path, and for selectively connecting power to the light assembly via a third conductive path, wherein the second conductive path is physically independent and separate from the third conductive path.

2. A power connection in accordance with claim 1 wherein the conductive path comprises a signaling path from the barrier movement operator and the control apparatus comprises circuitry responsive to control signals on the signaling path to selectively couple power to the power outlet.

3. A power connection in accordance with claim 1 comprising a wireless receiver connected to the control apparatus to receive wireless signals from the barrier movement operator.

4. A power connection in accordance with claim 3 wherein the control apparatus responds to wireless control signals received by the wireless receiver to selectively connect power to the power outlet.

5. A barrier movement operator system, comprising:

a connector for removable connection to a source of mains power;

a first conductive path from the connector to a barrier movement operator to supply mains power to the barrier movement operator;

a power outlet for a barrier movement operator accessory;

a second conductive path from a power control apparatus of the barrier movement operator to the power outlet;

a third conductive path from the power control apparatus to a linht assembly of the barrier movement operator, wherein the third conductive path is physically independent and separate from the second conductive path; and a control apparatus, of the barrier movement operator, and disposed within a housing of the barrier movement operator, for selectively connecting power to the power outlet via the second conductive path, and for selectively connecting power to the light assembly via the third conductive path.

6. A power connection in accordance with claim 5 wherein the power outlet comprises a light bulb socket.

7. A power connection in accordance with claim 5 wherein the power outlet comprises a power socket for removably connecting power to apparatus.

8. A power connection in accordance with claim 5 wherein the power outlet comprises a light bulb socket and a power socket for removably connecting power to apparatus.

9. A power connection in accordance with claim 5 wherein the power outlet comprises a light bulb socket.

10. A power connection in accordance with claim 5 wherein the power outlet comprises a power socket for removably connecting power to apparatus.

11. A power connection in accordance with claim 5 wherein the power outlet comprises a light bulb socket and a power socket for removably connecting power to apparatus.

* * * * *

UNITED STATES PATENT AND TRADEMARK OFFICE

CERTIFICATE OF CORRECTION

PATENT NO. : 7,378,760 B2
APPLICATION NO. : 10/843918
DATED : May 27, 2008
INVENTOR(S) : Robert J. Olmsted It is certified that error appears in the above-identified patent and that said Letters Patent is hereby corrected as shown below:

Claim 1, Column 3, Line 32; Change “operator:” to -- operator; --; and

Claim 5, Column 4, Line 17 (approx); Change “linht” to -- light --.

Signed and Sealed this

Twelfth Day of August, 2008

JON W. DUDAS
*Director of the United States Patent and Trademark Office*